US005709541A

United States Patent [19]

Gensler et al.

[11] Patent Number: 5,709,541

[45] Date of Patent: Jan. 20, 1998

[54] METHOD AND APPARATUS FOR REDUCING $NO_x$ EMISSIONS IN A GAS BURNER

[75] Inventors: Wayne C. Gensler, Point Pleasant; John van Eerden, Churchville, both of Pa.

[73] Assignee: Selas Corporation of America, Dresher, Pa.

[21] Appl. No.: 494,377

[22] Filed: Jun. 26, 1995

[51] Int. Cl.[6] ..... F23C 9/00

[52] U.S. Cl. ..... 431/10; 431/115; 431/8; 431/348; 431/187

[58] Field of Search ..... 431/115, 8, 9, 431/116, 10, 181, 187, 348

[56] References Cited

U.S. PATENT DOCUMENTS

| | | | |
|---|---|---|---|
| 1,786,887 | 12/1930 | Bell | 431/181 |
| 3,032,097 | 5/1962 | Marshall | 431/9 |
| 3,202,203 | 8/1965 | Reed | 431/181 |
| 3,817,232 | 6/1974 | Nakajima et al. . | |
| 3,957,418 | 5/1976 | Sata . | |
| 4,125,359 | 11/1978 | Lempa . | |
| 4,257,763 | 3/1981 | Reed | 431/188 |
| 4,487,573 | 12/1984 | Gottschlich et al. . | |
| 4,505,666 | 3/1985 | Martin et al. | 431/10 |
| 4,659,305 | 4/1987 | Nelson et al. . | |
| 4,874,310 | 10/1989 | Seemann et al. . | |
| 5,044,931 | 9/1991 | Van Eerden et al. . | |
| 5,131,838 | 7/1992 | Gensler et al. . | |
| 5,147,199 | 9/1992 | Perthius et al. | 431/10 |
| 5,154,596 | 10/1992 | Schwartz et al. | 431/181 |
| 5,180,302 | 1/1993 | Schwartz et al. . | |
| 5,259,342 | 11/1993 | Brady et al. . | |
| 5,271,729 | 12/1993 | Gensler et al. . | |
| 5,299,930 | 4/1994 | Weidman | 431/10 |
| 5,316,469 | 5/1994 | Martin et al. . | |
| 5,326,254 | 7/1994 | Munk . | |
| 5,329,955 | 7/1994 | Gensler et al. . | |
| 5,347,958 | 9/1994 | Gordon, Jr. . | |
| 5,542,839 | 8/1996 | Kelly | 431/10 |

FOREIGN PATENT DOCUMENTS

| | | | |
|---|---|---|---|
| 0096809 | 7/1980 | Japan | 431/190 |
| 0078206 | 5/1985 | Japan | 431/8 |
| 0123910 | 5/1988 | Japan | 431/187 |
| 2146113 | 4/1985 | United Kingdom | 431/10 |

*Primary Examiner*—Carl D. Price
*Attorney, Agent, or Firm*—Austin R. Miller

[57] ABSTRACT

A method and apparatus for reducing $NO_x$ emissions in a gas burner in which the burner includes a burner supply for supplying fuel gas and primary air to the furnace and projecting the fuel gas into the furnace, a secondary air supply for supplying secondary air to the burner, and a recirculating device for mixing the secondary air with the spent gases inside the furnace, which is then recirculated and combusted to reduce $NO_x$ gases. The method of the invention includes the steps of supplying fuel gas and primary air to the furnace, projecting the fuel gas into the furnace, combusting the fuel gas and primary gas to produce spent gases, supplying secondary air to the furnace, mixing the secondary air with the spent gases inside the furnace to produce diluted air, and recirculating and combusting the diluted air with the fuel gas and primary air to reduce $NO_x$ emissions.

11 Claims, 4 Drawing Sheets

METHOD AND APPARATUS FOR REDUCING $NO_X$ EMISSIONS IN A GAS BURNER

BACKGROUND OF THE INVENTION

1. Field of the Invention

This invention relates to a burner, particularly to one for burning a gaseous fuel, and further relates to a method of burning a gaseous fuel in a manner to produce combustion gases having a low content of nitrogen oxide. Hereinafter, nitrogen oxides, which are primarily nitric oxide and nitrogen dioxide, are collectively referred to as "$NO_x$".

2. Description of the Prior Art

Major environmental and other problems have been encountered in the production of flue gases containing high contents of $NO_x$. The $NO_x$ tends to react under atmospheric conditions to form environmentally unacceptable conditions, including the widely known phenomena known as urban smog and acid rain. In the United States and elsewhere, environmental legislations and restrictions have been enacted, and more are expected to be enacted in the future, severely limiting the content of $NO_x$ in flue gases.

In U.S. Pat. No. 4,874,310, granted Oct. 17, 1989 to Selas Corporation of America, the assignee hereof, a controlled primary air inspiration gas burner was disclosed, in which the introduction of control primary air was controlled in order to provide a substantial reduction of the content of nitrogen oxides in the flue gas. Such a burner includes extra piping for the introduction and control of the primary air, and this sometimes introduces expense and possible complications, especially in furnace installations utilizing a very large number of burners. Other endeavors have been made to reduce the content of $NO_x$ in furnace flue gases but many have been found unattractive in view of their requirement of too much operator attention, and in view of the need for extremely attentive control in order to assure that there will be no violation of existing environmental laws.

It has been the general indication in the prior art for burners that reduced $NO_x$ content can be obtained by avoiding secondary air, by using substantially entirely primary air, and by firing the burner as close as possible to its maximum firing capacity. Additionally, it has also been known that $NO_x$ emissions can be reduced in some instances in premix burners by creating a screen of premix combustion products, introducing secondary gaseous fuel for admixture with the screen, and exposing the secondary air to the mixture for reaction with the secondary gaseous fuel. Such a burner is disclosed in U.S. Pat. No. 5,044,931, granted Sep. 3, 1991 to Selas Corporation.

Other endeavors have also been made to reduce the content of $NO_x$ in furnace flue gases. For example, it has also been known in the prior art to attempt to reduce $NO_x$ gases by utilizing an inspirated stage combustion burner, such as that disclosed in U.S. Pat. No. 5,271,729, granted Dec. 21, 1993 to Selas Corporation. This burner includes two staged premix units with one unit running very lean and the second unit extending into the furnace and running very rich, the combination being stoichiometric. However, this burner is limited to 50% hydrogen by volume to prevent backfire.

External flue gas recirculation systems have also been used to reduce $NO_x$ emissions, such as the systems disclosed in U.S. Pat. No. 5,347,958 (issued Sep. 20, 1994); U.S. Pat. No. 5,326,254 (issued Jul. 5, 1994); U.S. Pat. No. 5,259,342 (issued Nov. 9, 1993); U.S. Pat. No. 4,659,305 (issued Apr. 21, 1987); U.S. Pat. No. 3,957,418 (issued May 18, 1976) and U.S. Pat. No. 3,817,232 (issued Jun. 18, 1974). However, these systems are expensive to produce and to operate. Consequently, a system is needed which can reduce $NO_x$ emissions, efficiently and reliably, and at low cost.

It is very important to be able to obtain the greatest reduction of $NO_x$ content possible while burning a high hydrogen content fuel, and that even in the event of operator error environmental laws will not be violated and the further operation of the plant and its equipment will not be enjoined by governmental action. Accordingly, a burner is needed which significantly reduces $NO_x$ gases produced and which is capable of burning a fuel with high fractions of hydrogen without backfire and a subsequent increase in $NO_x$.

OBJECTS OF THE INVENTION

It is therefore an object of the invention to provide a burner which can reduce $NO_x$ emissions efficiently and reliably while burning a high hydrogen content fuel.

It is another object of the invention to provide a burner which can reduce $NO_x$ emissions without the need for expensive external flue gas recirculating systems.

It is yet another object of the invention to provide a burner having a low $NO_x$ emission which is less influenced by tramp air, changes in firing rate, and hydrogen content in the fuel.

Still another object of the present invention is to provide a burner in which the majority of the gas and a little air are sent in one direction along the walls and most of the air and a minority of the gas are sent in another direction forwardly into the furnace, causing a dilution of the air with the flue gases within the furnace to achieve a significant reduction in $NO_x$ emissions without the large cost of external flue gas recirculation.

Other objects and advantages of this invention, will become apparent to one of ordinary skill in the art from the description of the invention contained herein, the appended claims and the drawings.

DRAWINGS

SUMMARY OF THE INVENTION

The present invention includes a method and apparatus for reducing $NO_x$ emissions in a gaseous fuel burner used in a furnace. The burner includes a burner supply means for supplying fuel gas and primary air to the furnace, having a combustion end located within the furnace for projecting the fuel gas into the furnace for combustion which produces spent flue gases, a secondary air supply means for supplying secondary air to the burner, and a recirculation means for mixing the secondary air with the spent gases inside the furnace space to produce a diluted air, which is recirculated and mixed with the partially combusted primary fuel gas to reduce $NO_x$ emissions.

In one embodiment of the present invention, a nozzle mix burner is used, having primary jets for projecting the majority of fuel gas or premix outward radially into the furnace and secondary jets for projecting a minority of fuel gas forward axially into the furnace. The secondary jets are capable of mixing the secondary air with the spent gases inside the furnace to produce the recirculated air. Alternatively, jet tubes may be used to supply fuel gas or premix to the furnace in which a separate secondary jet is used to mix secondary air with the spent gases. Additionally, the invention can be used in a vertical furnace having a floor burner and secondary air vents for mixing and recirculating the secondary air with the spent gas inside the furnace.

DETAILED DESCRIPTION OF THE INVENTION

It will be appreciated that the following description is intended to refer to the specific forms of the invention selected for illustration of the drawings, and is not intended to define or limit the invention, other than as in the appended claims.

Figures 1, 2:
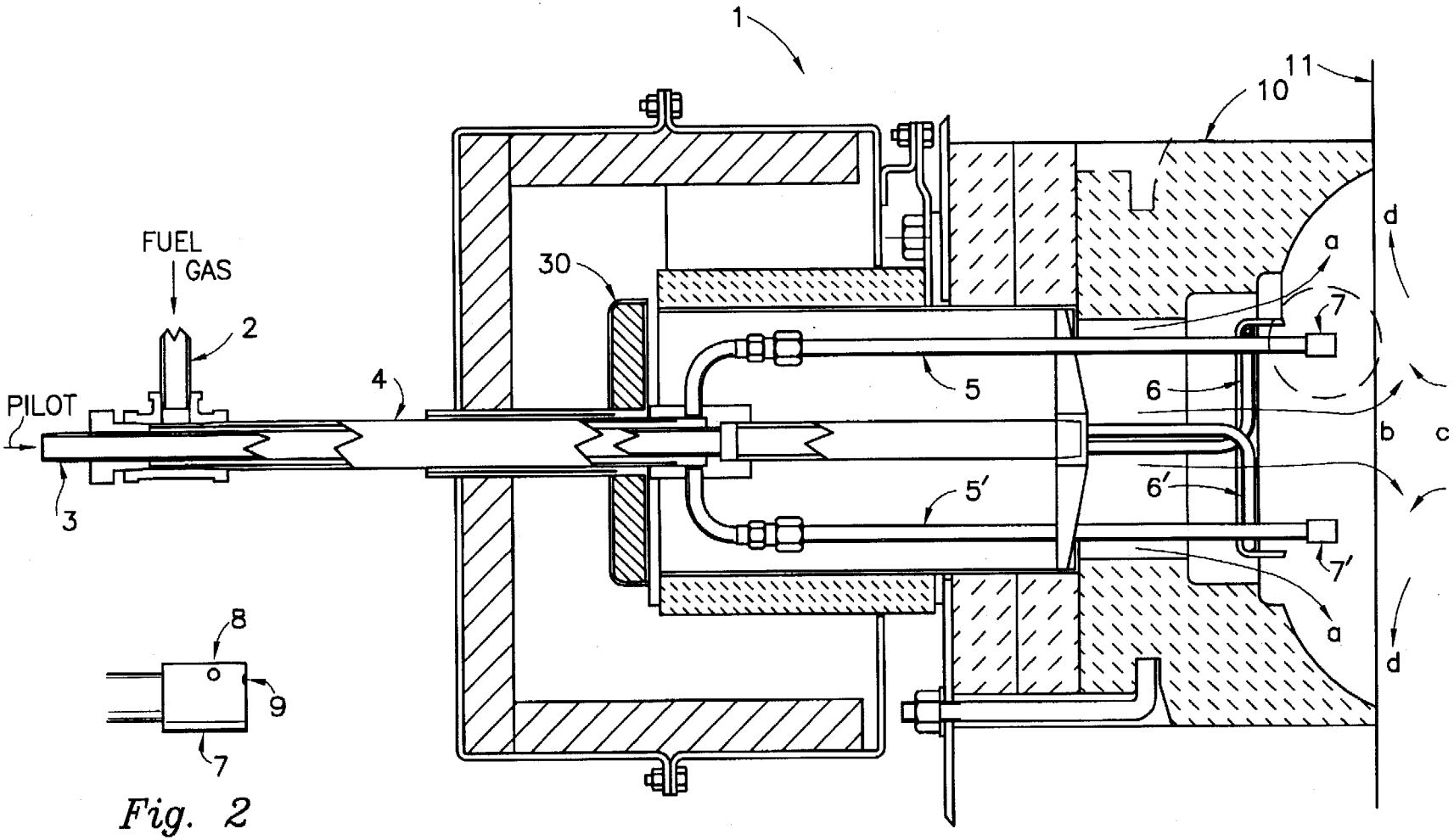
FIG. 1 is a sectional view showing a first embodiment of the invention utilizing a nozzle mix burner.
FIG. 2 is a detailed view of the burner tip of FIG. 1.

Turning now to the specific form of the invention illustrated in the drawings, FIGS. 1 and 2 disclose a first embodiment of the invention. The burner 1 may include fuel gas inlet 2 and pilot gas inlet 3 which are connected in a conventional manner to conduit 4 within the burner. Fuel gas inlet 2 may alternatively include a blower or inspirator to form a premixture. Gas or premix is then supplied to the furnace by way of gas injector tubes 5 and 5', which are also conventionally connected to conduit 4 and which extend into the furnace. Pilot injector tubes 6 and 6' are also connected in a conventional manner to conduit 4 for supplying pilot gas to the furnace from pilot gas inlet 3. Ports 7 and 7', containing primary jet 8 and secondary jet 9 are attached to injector tubes 5 and 5' to project fuel gas radially and axially into the furnace, respectively.

Air may enter the burner and the furnace through air shutter 30 which works in a conventional manner to supply air to the system. Primary air, designated by path (a) travels along burner block 10 and furnace wall 11 for combustion of the fuel gas projected from primary jet 8. Secondary air, designated by path (b), may travel inwardly of ports 7 and 7' for combustion with the fuel gas projected from secondary jet 9. Spent flue gas descends along path (c) and is recirculated by being mixed with the secondary air to form diluted air, which is caused to flow outwardly along path (d) along furnace wall 11 where it is burned with the primary air and the fuel gas projected from primary jet 8.

The operation of this embodiment of the invention is as follows. Pilot gas may enter through pilot gas inlet 3, moving forwardly through conduit 4, and pilot gas tubes 6, to form a vortex of burning gas within burner block 10. This vortex of gas may be combusted to raise the temperature within burner block 10 to a suitable level for operating the burner. This is normally about 1600° F., but can be varied depending upon the application. The use of a vortex pilot, which is optional, has significant safety advantages in that it can be used at operating temperatures below the self-ignition point.

Primary fuel gas or premix may enter through primary fuel gas inlet 2 and is transported forwardly along conduit 4 into gas injector tubes 5 and 5' to ports 7 and 7'. A majority of the gas is then projected outward radially from primary jet 8 to be combusted with primary air traveling along path (a). The angle at which the gas is projected from primary jet 8 is not particularly restricted. However, the gas jet angle should be chosen to keep visible flame away from process tubes while also keeping the gas injector tubes protected within the plane of the wall. The jets should also be angled to reduce any refractory erosion which may occur from gas running along the furnace wall at high speed.

Additionally, the positions of the gas injector tubes 5 and 5' and ports 7 and 7' are not particularly limited but are preferably outwardly of the center of the burner towards the sides, outside the secondary air flow. Although this is mechanically less convenient, the outside position of the jets significantly reduces high speed flame flutter, pulsing and combustion noise, and makes the burner significantly less sensitive to changes in firing rate, fuel composition, excess air, projection, and block shape. Also, the position of the gas tubes within the air stream ingeniously aids in cooling the gas jets. This embodiment of the present invention also has the significant benefit over traditional burners that it may operate at significantly lower gas pressures.

A minority of gas is projected from secondary jet 9 forwardly into the furnace to be combusted with secondary air flowing along path (b). The amount of gas projected from the secondary jets is not particularly restricted but is preferably less than 25% and greater than 10% of the total fuel gas used. The combustion of the gas from the secondary jets causes the secondary air to be mixed with spent flue gases descending along path (c), which are primarily the result of the combustion of the gas from the primary jets. Good mixing of air and spent gases is believed to occur due to micro-explosions of the gas combusted from the secondary jets. The forcible mixture of the secondary air and the spent flue gases forms a diluted air which is recirculated along the furnace wall along path (d) to be combusted with the primary air and the fuel gas projected from the primary jets, causing a significant reduction in $NO_x$ gases produced during this combustion.

Figure 3:
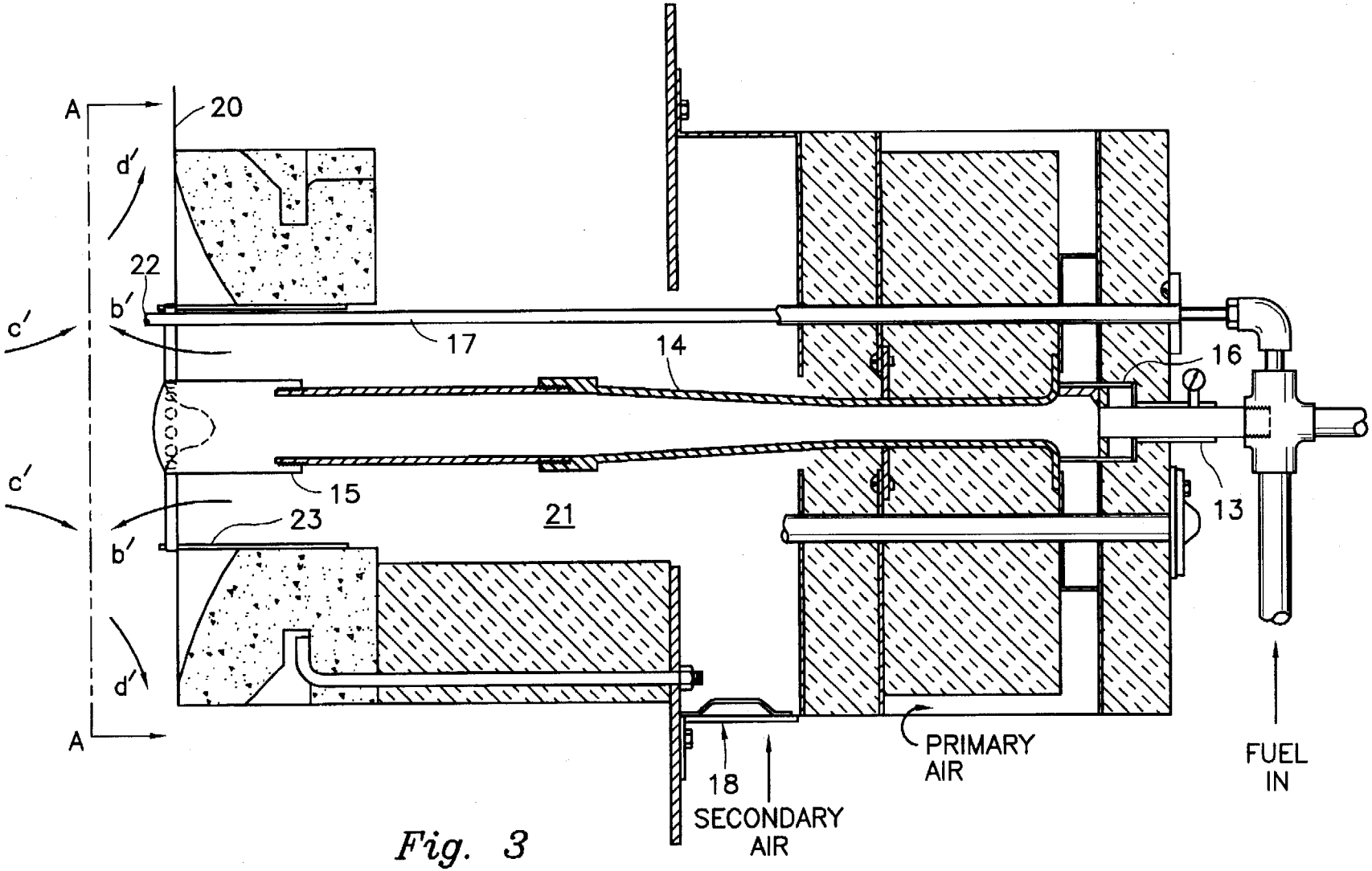
FIG. 3 is a sectional view of a second embodiment of the invention utilizing a premix burner tip.
Figure 4:
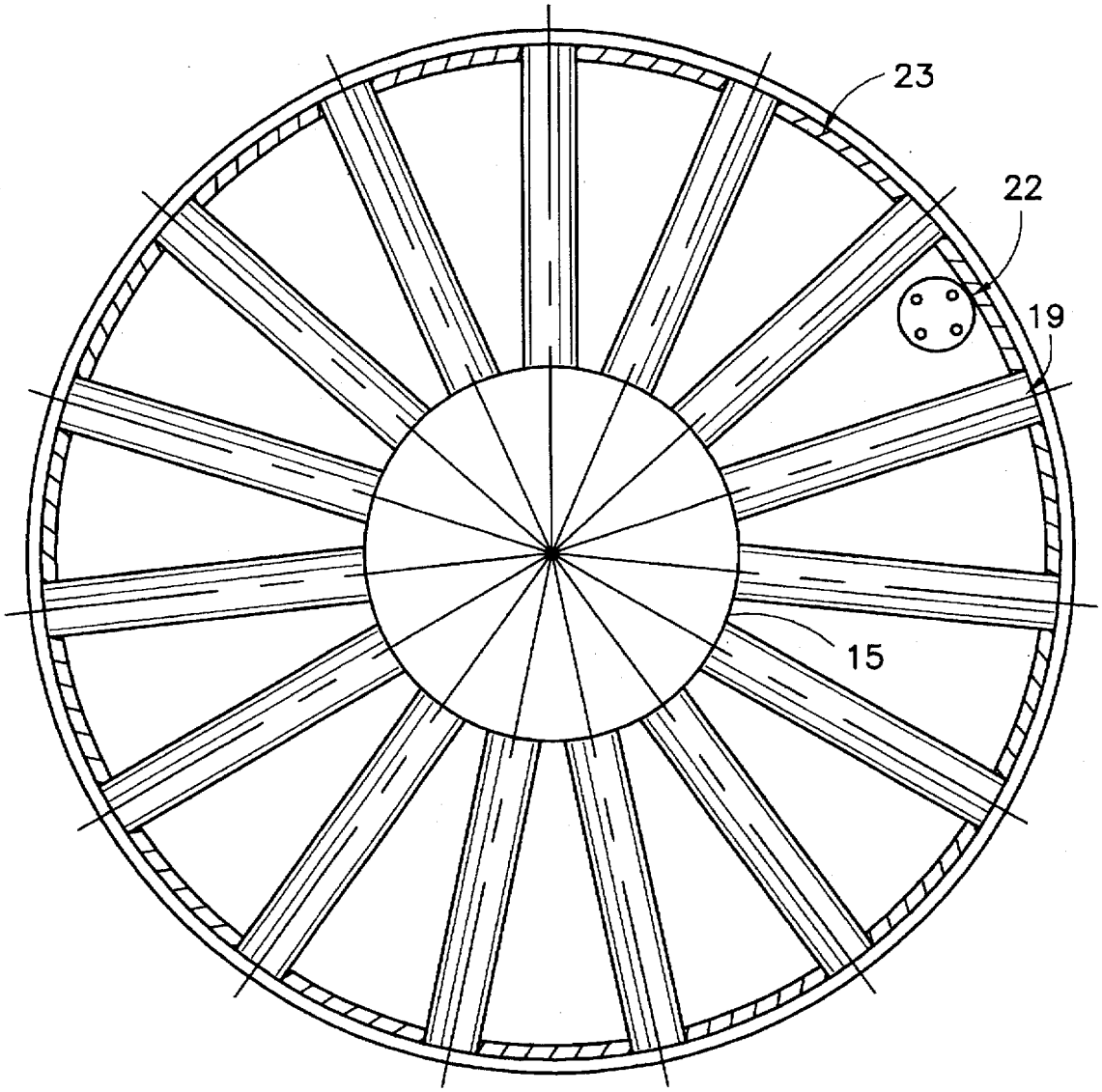
FIG. 4 is a cross-sectional view along line A—A of the embodiment shown in FIG. 2.

Alternatively, as depicted in FIGS. 3 & 4, primary fuel may enter through primary fuel inlet 13 to be premixed with primary air entering through primary air shutter 16 in a conventional manner. The premix is then transported through venturi 14 into tip 15 to which it is connected in a conventional manner. Tip 15 has a plurality of primary jet tubes 19 at its combustion end, located within the furnace, for projecting the premix radially into the furnace for combustion along furnace wall 20.

Secondary fuel may then be transmitted forwardly along a secondary fuel inlet 17 having secondary jets 22 at its combustion end, located within the furnace. The secondary jets project the secondary fuel forwardly into the furnace. The angle at which the secondary fuel is projected is not particularly restricted but is preferably less than 30° from center. Secondary air enters through secondary air shutter 18, flowing forwardly into the furnace through annulus 21 in a conventional manner, and entering the furnace along path (b)'. Annulus 21 may also include snout 23, extending forwardly into the furnace to aid in directing the secondary air flow and protecting the tubes. The exact length of snout 23 is not particularly restricted but should be long enough to adequately aid in the forcible mixture of the secondary air with the flue gases.

The secondary air is burned with the fuel projected from secondary jets 22 and is thereby mixed with spent flue gases descending along path (c)' to form a diluted air which is recirculated along path (d)'. The diluted air is combusted with the premix projected along the furnace wall from primary jet tubes 19, causing a significant reduction in the $NO_x$ gases produced.

Figure 6:
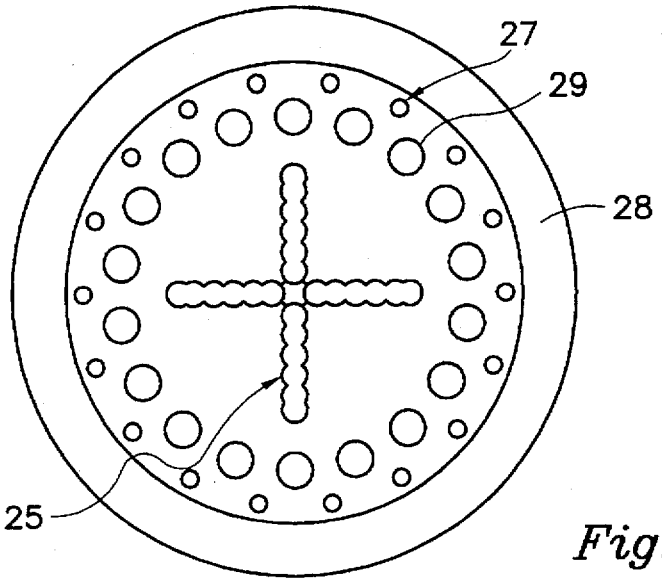
FIG. 6 is a cross-sectional view along line B—B of FIG. 4.
Figure 5:
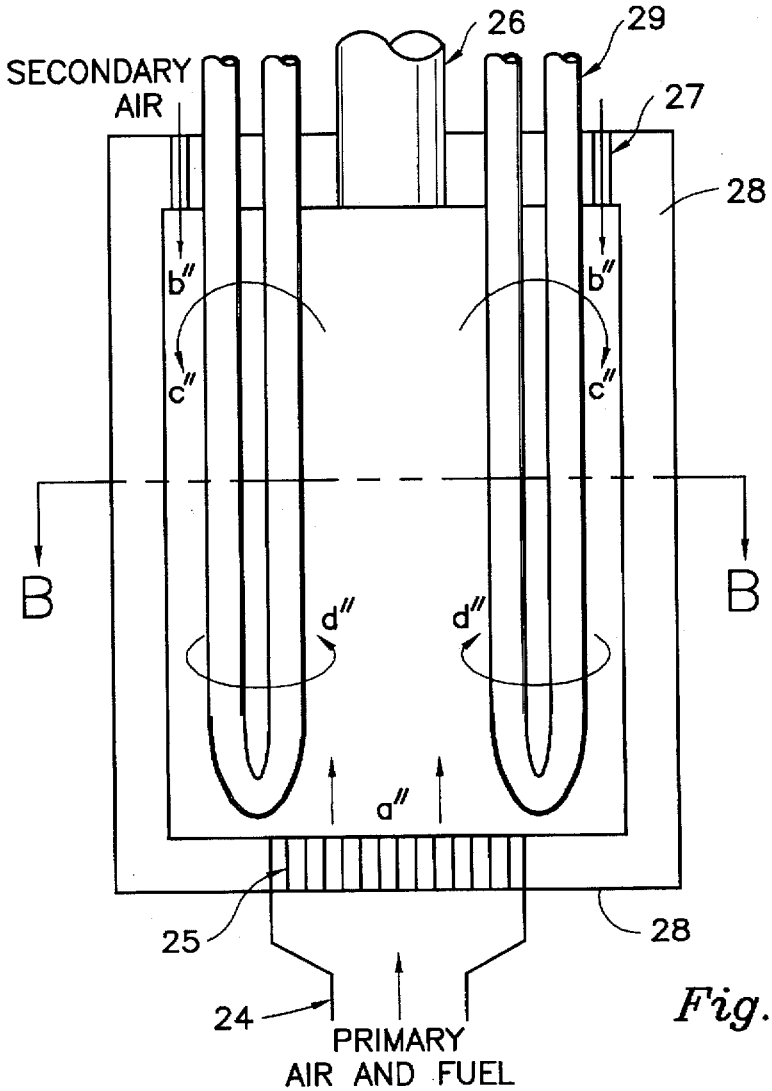
FIG. 5 is a sectional view of another embodiment of the present invention which is used in a vertical furnace having a floor burner.

Additionally, as shown in FIGS. 5 and 6, a vertical furnace may be used with a floor-mounted burner. A fuel rich primary air and fuel premix is transported forwardly along primary fuel inlet 24 through burner array 25 situated within furnace floor 28 to supply fuel gas to the furnace. Primary air thus enters along path (a)" as part of the premix. The premix is then projected into the furnace and burned, heating fluid contained in process tubes 29. This combustion produces flue gases, some of which leave the furnace by way of furnace stack 26, with the remainder recirculating and descending along path (c)". Inside the furnace, secondary air is pulled into the furnace by the draft through secondary air ports 27 along path (b)". The secondary air entering through secondary ports 27 is thereby mixed and recirculated with the spent flue gases traveling along path (c)" along path (d)" to be burned with the premix. This results in a significantly reduced amount of $NO_x$ gases.

In previous conventional burners, primary fuel and air may inadvertently mix to a small degree with descending furnace gases; however, it has been found that sufficient $NO_x$ reduction is not realized in these burners. This is because the spent gases must be sufficiently mixed and recirculated with secondary air to create a sufficiently diluted air to be mixed with the primary fuel air for combustion. In conventional boilers this was sometimes done by recirculating gases after they had left the furnace. However, it has ingeniously been discovered that if the dilution of the air with spent gases could be accomplished inside the furnace, a significantly larger reduction in $NO_x$ could be obtained without the large cost of an external flue gas recirculation system.

By producing a gaseous fuel burner in the manner set forth in the appended claims and described herein, it is possible to significantly reduce the $NO_x$ emissions produced by combusted gases in the furnace. It is believed that the lowest $NO_x$ would be obtained if the air is well mixed with the spent gases inside the furnace before returning to mix and burn with the fuel. With forced air or with lean premix projected perpendicular to the furnace wall, good mixing may be nearly realized. This does not occur with conventional draft air systems because draft air is normally very lazy, and thus usually cannot itself provide sufficient mixing of the furnace atmosphere, resulting in pockets of high oxygen and thus higher $NO_x$. It has been ingeniously discovered that the apparatus and method of the present invention will allow for sufficient mixing of the gases inside the furnace, leading to significantly reduced $NO_x$.

In traditional burners, the leaner nozzle-mix flames created very high $NO_x$ gases. However, when secondary jets were added, it was unexpectedly discovered that the $NO_x$ was significantly lowered. This unusual behavior is believed to be attributed to the fact that the secondary gas jets create micro-explosions which generate enough energy to forcibly mix the air with the furnace atmosphere, also resulting in significantly lower $NO_x$ emissions.

Moreover, it was found that if the gas jets were simply a low pressure premix and attached to the burner tip, the $NO_x$ would increase as predicted in conventional burner systems (a lean nozzle-mix burner creates the highest $NO_x$). When compressed air was projected from the secondary jets instead of secondary fuel, there was no change in $NO_x$ emissions. Thus, it is believed that it is the micro-explosions in the nozzle-mix burner which provide the energy needed to forcibly mix the secondary air with the spent gases, leading to a significant reduction in $NO_x$ gases. The limit of secondary fuel appears to be the tolerance of the furnace for these micro-explosions. However, secondary fuel should not be required with a system such as the vertical furnace shown in FIG. 4, since the air can be drawn and mixed directly with the spent gases inside the furnace. Significant $NO_x$ reduction can also be obtained if a forced air system is used.

In the situation where a premix burner is utilized, a premix ratio of 2:1 to 5:1 seems optimum for high temperature furnaces, while higher ratios will add flame stability for lower temperatures. The benefits of using a premix burner here are twofold; large holes are possible with less chance of plugging with mill scale and dirt, and the air acts as a coolant to prevent gas cracking and plugging of the holes. The air may also be staged with lean premix when the fuel composition is backfire resistant. The main benefit here is lower $NO_x$ through better mixing and a more distributed heat release.

Although this invention has been shown and described in relation to particular burners, it will be appreciated that a wide variety of changes may be made without departing from the spirit and scope of this invention. Various configurations and burner types may be used. For example, a nozzle-mix burner may be used with a forced air system without the use of secondary jets. Additionally, the burner may be used with various types of gas fuels such as propane, methane or hydrogen mixtures. Certain features shown in the drawings may be modified or removed in specific cases, and secondary passageways and controls and other mechanical features may be varied or dispensed with without departing from the spirit and scope of the invention. Accordingly, the scope of the invention is not intended to be limited by the foregoing description, but only as set forth in the appended claims.

What is claimed is:

1. The low $NO_x$ gaseous fuel burner to be used in a furnace comprising:

a burner supply means arranged substantially axially for supplying primary fuel and primary air to said furnace, secondary fuel supply means having a combustion end extending and directed substantially axially into said furnace, a secondary air supply means arranged to direct a supply of secondary air into said furnace adjacent said secondary fuel supply means, said combustion end of said secondary fuel supply means being directed for projecting said secondary fuel substantially axially into said furnace for combustion with said secondary air, said combustion thereby producing spent gases, a recirculating means positioned relative to said combustion end of said secondary fuel supply means to effect mixing of said secondary air with said secondary fuel and with said spent gases inside said furnace to produce diluted air, said diluted air being recirculated and combusted with said primary air and fuel to reduce $NO_x$ content in the resulting combustion gases.

2. The burner defined in claim 1, wherein said burner supply means comprises:

a fuel gas inlet for supplying said fuel gas to said furnace, a conduit means connected to said fuel gas inlet and capable of transporting said fuel gas to said furnace, at least two injector tubes extending into said furnace, said injector tubes being connected to said conduit means, said injector tubes being capable of transporting said fuel gas to said combustion end.

3. The burner defined in claim 1, wherein said combustion end comprises primary jets defined in said burner supply means, said primary jets being capable of projecting a majority of said fuel gas radially into said furnace, and wherein said recirculating means comprises secondary jets defined in said burner supply means, said secondary jets being capable of projecting a minority of said fuel gas axially into said furnace, and being capable of combusting said minority of fuel gas with said secondary air to mix said secondary air with said spent gases inside said furnace to produce said diluted air.

4. The burner defined in claim 3, wherein said minority of said fuel gas projected from said secondary jets is less than about 25% of said fuel gas.

5. A low $NO_x$ gaseous fuel burner for use in a furnace comprising:

a fuel gas inlet for supplying fuel gas to said furnace, a primary air supply connected to said furnace for supplying primary air to said furnace, a secondary air supply connected to said furnace for supplying secondary air to said furnace, a conduit connected to said fuel gas inlet for transporting said fuel gas to said furnace, an injector connected to said conduit and extending into said furnace, said injector having primary and secondary jets, wherein said primary jets are capable of projecting a majority of said fuel gas from said injector radially into said furnace to be combusted with said primary air, and said secondary jets are capable of projecting a minority of said fuel gas axially into said furnace to be combusted with said secondary air inside said furnace to produce diluted air, said diluted air being recirculated and combusted with said majority of fuel gas and said primary air.

6. The burner defined in claim 5 wherein said minority of said fuel gas projected from said secondary jets is less than about 25% of said fuel gas.

7. A low $NO_x$ gaseous fuel burner for use in a furnace comprising:

a premix intake having a primary fuel inlet and a primary air supply, a conduit connected to said premix intake, said conduit having a combustion end located within said furnace, said combustion end having a plurality of premix jet tubes for projecting said premix into said furnace for combustion, said combustion producing spent gases, a secondary fuel supply located within said conduit and having a combustion end located within said furnace, said combustion end having at least one secondary jet, a secondary air supply connected to said furnace for supplying secondary air to said furnace, wherein said secondary jet is positioned relative to said plurality of premix jet tubes to supply secondary fuel to effect mixing of said secondary air with said spent gases inside said furnace to produce diluted air and to recirculate and combust said diluted air with said premix to reduce $NO_x$ emissions.

8. A low $NO_x$ gaseous fuel burner for use in a vertical furnace comprising:

a primary fuel gas and primary air inlet, a burner array located in a wall of said vertical furnace and connected to said primary air and fuel gas inlet for projecting said primary air and fuel outwardly into said furnace, said primary air and fuel being combusted and producing spent gases, a plurality of secondary air vents defined in a wall of said furnace for supplying secondary air to said furnace, wherein said secondary air vents are positioned relative to said burner array to effect mixing of said secondary air with said spent gases inside said furnace to produce diluted air, and to recirculate said diluted air for combustion with said primary air and fuel to reduce $NO_x$ emissions.

9. A method for reducing $NO_x$ emissions in a gaseous fuel burner used in a furnace containing spent gases, comprising the steps of:

supplying primary fuel gas and primary air to said furnace, projecting said primary fuel gas in a substantially radial direction into said furnace, combusting said fuel gas and primary air to produce spent gases, supplying secondary fuel gas and secondary air in a substantially axial direction and projecting it into said furnace, mixing said secondary air by combustion of secondary fuel gas in said furnace with said spent gases inside said furnace to produce diluted air, and recirculating and combusting said diluted air inside said furnace to reduce $NO_x$ emissions in the resulting combustion gases.

10. A low $NO_x$ gaseous fuel burner to be used in a furnace comprising:

(a) a burner supply means for supplying fuel gas and primary air to said furnace for combustion to produce spent gases, said burner supply means comprising:

a premix intake, said premix intake having an air supply means for supplying air to said fuel gas to form a premix of said fuel gas and said primary air for projection into said furnace, and a conduit means, connected to said premix intake for transporting said premix to said furnace, said conduit means extending into said furnace and having a plurality of jet tubes defined therein capable of projecting said premix radially into said furnace;

(b) a secondary air supply means for supplying secondary air to said furnace; and (c) a recirculating means to effect mixing of said secondary air with said spent gases inside said furnace to produce diluted air, said diluted air being recirculated and combusted with said primary air and fuel gas to reduce $NO_x$ gases, said recirculating means comprising a secondary fuel inlet for supplying secondary fuel to said furnace, said secondary fuel inlet extending into said furnace and having at least one secondary jet capable of projecting said secondary fuel axially into said furnace, said secondary jet being capable of combusting said secondary fuel with said secondary air to mix said secondary air with said spent gases inside said furnace to produce said diluted air.

11. A low $NO_x$ gaseous fuel burner to be used in a vertical furnace comprising:

(a) a burner supply means for supplying fuel gas and primary air to said vertical furnace comprising a floor burner having a burner array located in a wall of said furnace for projecting said fuel gas and said primary air into said vertical furnace for combustion to produce spent gases; and (b) a recirculating means for mixing said secondary air with said spent gases inside said vertical furnace to produce diluted air, said diluted air being recirculated and combusted with said primary air and fuel gas to reduce $NO_x$ gases, said recirculating means comprising a plurality of secondary air supply vents defined in a wall of said furnace capable of supplying said secondary air to said furnace to produce said diluted air.

* * * * *